US005940922A

United States Patent [19]

Saxon et al.

[11] Patent Number: 5,940,922

[45] Date of Patent: Aug. 24, 1999

[54] EASY INSERT COMPOSITE TUBE CLEANER

[75] Inventors: Gregory J. Saxon; Jerzy Krysicki, both of Oakmont, Pa.

[73] Assignee: Conco Systems Inc., Verona, Pa.

[21] Appl. No.: 08/928,980

[22] Filed: Sep. 12, 1997

[51] Int. Cl.[6] ..... B08B 9/04

[52] U.S. Cl. ..... 15/104.061; 15/104.16

[58] Field of Search ..... 15/3.5, 104.05, 15/104.061, 104.16, 104.066, 104.068

[56] References Cited

U.S. PATENT DOCUMENTS 2,170,997 8/1939 Griffin .
2,418,509 4/1947 Griffin .
2,734,208 2/1956 Griffin .
4,281,432 8/1981 Saxon .
5,271,118 12/1993 Piotrowitz .
5,305,488 4/1994 Lyle .
5,437,073 8/1995 Smith .

*Primary Examiner*—Randall E. Chin
*Attorney, Agent, or Firm*—Armstrong, Westerman Hattori, McLeland & Naughton

[57] ABSTRACT

A composite tube cleaner has a shaft, nose portion and tail portion, and a plurality of metallic scraper devices spaced along the shaft. The scraper devices are U-shaped and have at least two leg portions which terminate as scraping sections. A plastic sheath is secured to and encloses the scraping sections and at least a portion of the leg portions, the sheath preferably having at least one inclined surface along the leg portion which extends outwardly to the scraping section.

16 Claims, 2 Drawing Sheets

EASY INSERT COMPOSITE TUBE CLEANER

CROSS REFERENCE TO RELATED APPLICATION

This application is related to application Ser. No. 08/928,847, now U.S. Pat. No. 5,784,745 filed on even date herewith in the names of the present inventors, and entitled "Easy Insert Tube Cleaner", which application is assigned to the assignee of the present application.

FIELD OF THE INVENTION

The present invention is to a tube cleaning device for use in cleaning the inner wall of a tube or conduit, and more specifically to a tube cleaner that is insertable into an open end of a tube, such as a condenser tube, and forced through the tube by a fluid, such as water, discharged from pressurized fluid gun to remove deposits on the inner wall surface of the tube.

BACKGROUND OF THE INVENTION

In the cleaning of the inner wall of tube, such as condenser tubes, in power plants, to improve the efficiency of heat transfer therethrough, a resilient scraping tool is inserted into an open end of the tube and a pressurized fluid is charged to the open end of the tube to propel the scraping tool through the tube. During passage through the tube, the scraping tool scrapes deposits from the inner wall of the tube and discharges the deposits from the other end of the tube. Such tube cleaners have been used extensively and examples of typical such tube cleaners are shown, for example, in U.S. Pat. No. 2,170,997; U.S. Pat. No. 2,418,509; U.S. Pat. No. 2,734,208, and U.S. Pat. No. 4,281,432. These tube cleaners use scraping elements that are spaced along a shaft, with scraping blades of adjacent scraping elements offset from each other so that the deposits on the inner tube wall are scraped away along the entire 360° inner circumference thereof. The scraper elements, with the scraper blades, are usually formed from steel and are flexible enough to be inserted into the open end of a tube while making contact with and removing deposits from the tube wall upon passage through the tube.

It is an object of the present invention to provide a tube cleaner which is more easily inserted into an open end of a tube to be cleaned.

It is another object of the present invention to provide a tube cleaner which is more easily inserted into an open end of a tube to be cleaned, which tube cleaner is a composite tube cleaner formed primarily of metal but which has a plastic sheath over the scraping elements to prevent metal-to-metal contact during passage of the tube cleaner through a tube.

SUMMARY OF THE INVENTION

The present invention is to a composite tube cleaner that is more readily insertable into an open end of a tube, the tube cleaner having a shaft with a nose portion at one end and a tail portion at the other, with a plurality of scraper devices disposed along the shaft between the nose and tail portions. The scraper devices are formed of metal and comprise a U-shaped scraper having a base and at least two leg portions extending towards the tail portion of the tube cleaner and having a scraping section extending outwardly from the end of the leg portion. A plastic sheath, such as a nylon molded sheath, is secured to and encloses the scraping section and at least a portion of the leg portion, which sheath has at least one inclined surface along the leg portion extending from the leg portion rearwardly and outwardly to the scraping section of the scraper device.

BRIEF DESCRIPTION OF THE DRAWINGS

The present invention will be more clearly understood by reference to the following description and the attached drawings, wherein.

DETAILED DESCRIPTION

Figure 2:
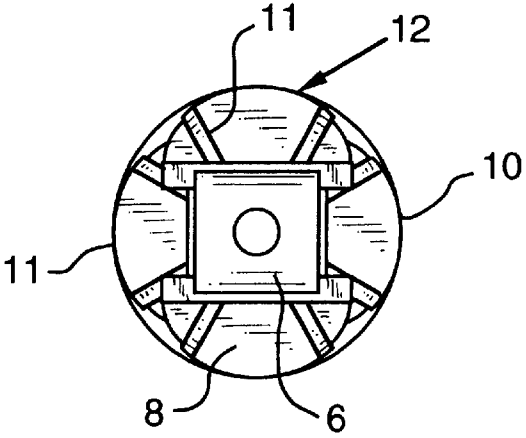
FIG. 2 is a front view of the composite tube cleaner shown in FIG. 1.
Figure 1:
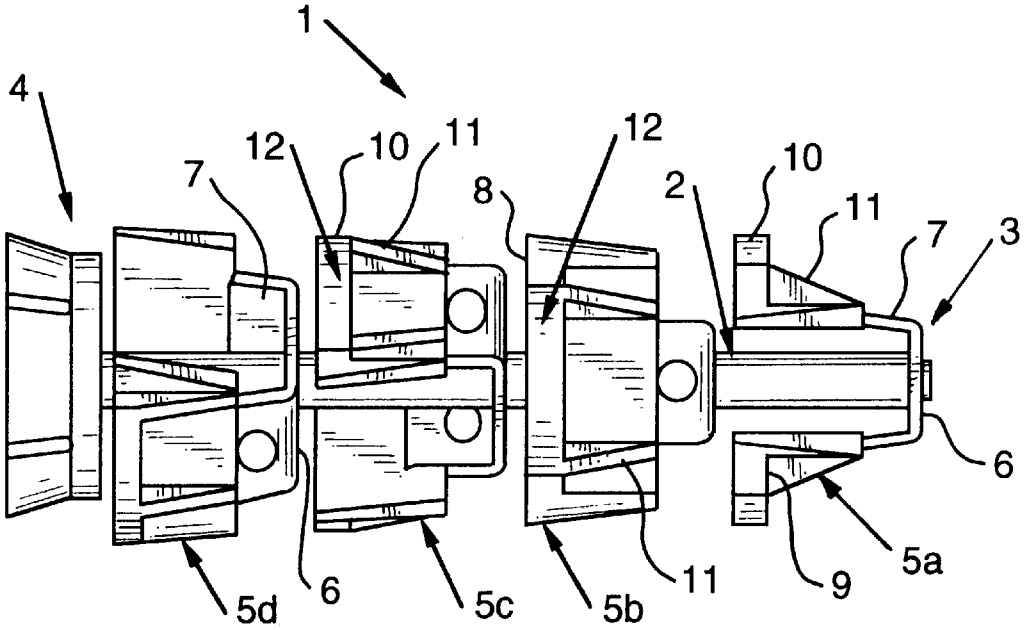
FIG. 1 is a side elevational view of the composite tube cleaner of the present invention.
Figure 3:
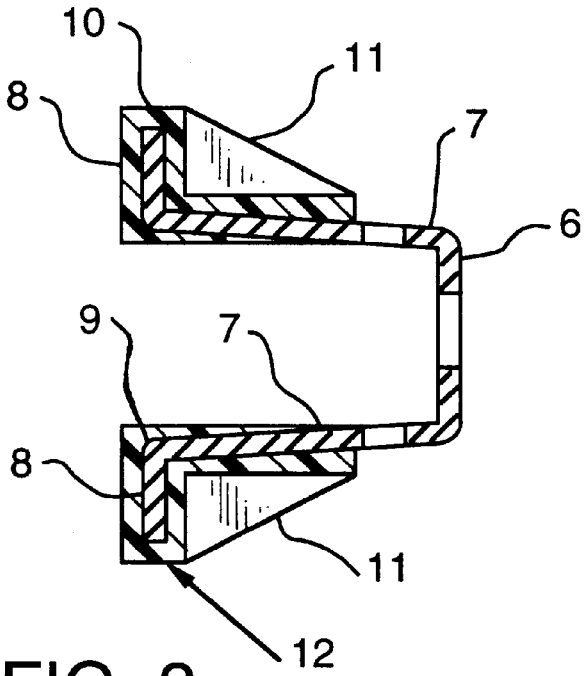
FIG. 3 is a cross-sectional view through a scraper device used on the composite tube cleaner.

Referring now to the drawings, a composite tube cleaner 1, in accordance with the present invention, for easy insertion into an open end of a tube to be cleaned, is shown having a shaft 2, a nose portion 3 at the front end and a tail portion 4 at the rear end thereof. The nose portion 3 may have a rivet head to hold scraper devices on the shaft 2 while the tail portion 4 is adapted to be impinged by a pressurized fluid to drive the tube cleaner through a tube, as is known in the art. A plurality of scraper devices 5, shown as four scraper devices 5*a*, 5*b*, 5*c* and 5*d* in FIG. 1 are spaced along the shaft 2 between the nose portion 3 and tail portion 4. The scraper devices 5 are U-shaped scrapers having a base 6 and at least two leg portions 7. The leg portions 7 extend in the direction of the tail portion 4 of the composite tube cleaner 1 and have at least two scraping sections 8 which extend outwardly from the terminal end 9 of the leg portion 7. The scraper devices 5 are positioned on the shaft 2 of the composite tube cleaner 1 such that leg portions 7 of each scraper device 5 is offset from leg portions of an adjacent scraper device 5. The positioning of such adjacent scraper device is not new but is used in commercially available tube cleaners.

In the present composite tube cleaner 1, the scraper devices 5 are formed of metal, such as steel, and a plastic sheath 10 is provided which is secured to and encloses the scraping sections 8 and at least a portion of the leg portion 7 thereof. In the preferred embodiment of the present invention, the plastic sheath 10 has at least one ramp or inclined surface 11 formed thereon along the leg portion 7 of the scraper device 5 which extends from the leg portion 7 rearwardly and outwardly to the scraping edge 12 of the scraping section 8 of the composite tube cleaner. Preferably, two such inclined surfaces 11 on each leg portion 7 are provided, as illustrated in the drawings.

The plastic sheath 10 may be formed from any plastic material having sufficient resistance to abrasion to provide a scraping force on the contaminants on the inner wall of a tube to be cleaned without abrading or disintegrating for a desired number of passes through a tube. One such plastic is nylon. In forming the composite tube cleaner, the steel scraper device 5 is preferably punched out of a metal strip of steel, such as carbon steel or stainless steel, and the plastic sheath 10 molded around the scraping sections 8 and at least a portion of the leg portion 7. The scraper devices 5 are then secured to the shaft 2 between the nose portion 3 and tail portion 4 which are then affixed.

The plastic sheath 10 may incorporate therein an abrasive material. For example, a glass-filled nylon plastic material may be used, or pumice, silica, or some other fine abrasive material may be incorporated into the plastic. Other non-deleterious materials may also be incorporated into the plastic used for the plastic sheath, such as colorants or luminescent materials which would give the scraper a "glow-in-the-dark" appearance for easy locating.

Figure 4:
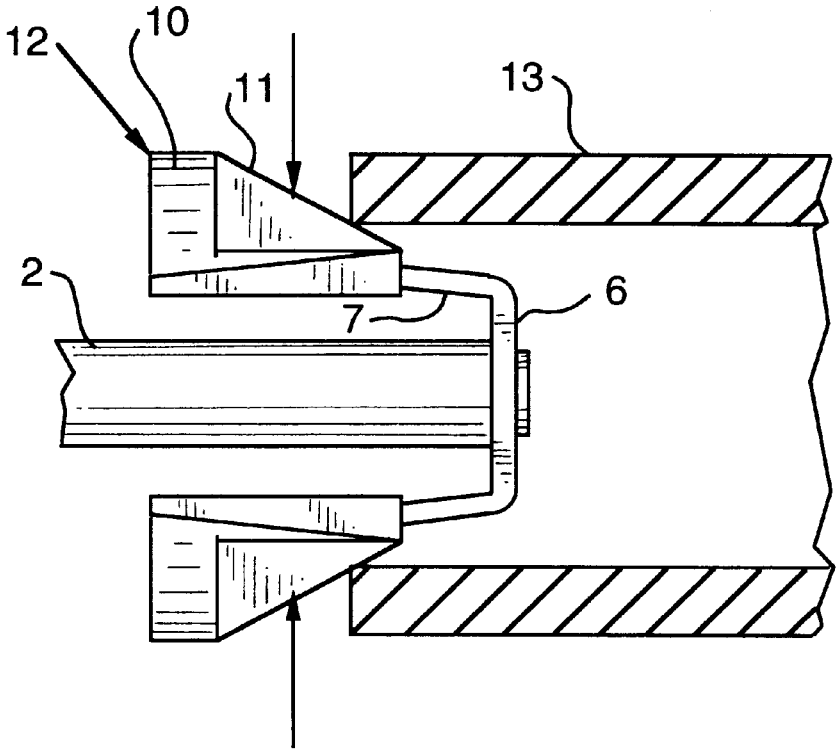
FIG. 4 is a view showing insertion of the composite tube cleaner of FIG. 1 into an end of a tube to be cleaned.

The plastic sheath 10 provides a number of benefits over existing metal tube cleaners. The ramp or inclined surface 11 causes the leg portions 7 to bend inwardly upon insertion into a tube 13, as indicated by the arrows in FIG. 4, and thus causes the leg portions to move together and provides for a less severe contact of the tube end with the scraping section 8, and plastic sheath 10 thereabout, of the tube cleaner 1. By thus moving the leg portions 7 together, an easier insertion of the tube cleaner 1 into an open end of the tube 13 is achieved. Also, in some situations, metal-to-metal contact of a scraper blade and the inner wall of a tube is of concern and avoided by use of the present easy insert composite tube cleaner. In addition, as previously mentioned, various additives may be provided in the plastic used in the sheath to accomplish various tube cleaning objectives.

What is claimed is:

1. A composite tube cleaner comprising a shaft having a nose portion at a front end and a tail portion at a rear end thereof, and a plurality of spaced scraper devices secured to the shaft intermediate the nose portion and tail portion, said scraper devices comprising a metallic U-shaped scraper having a base and at least two leg portions, said leg portions extending in the direction of said tail portion and having scraping sections extending outwardly from a terminal end thereof; and a plastic sheath secured to and enclosing said scraping section and at least a portion of said leg portion.

2. The composite tube cleaner as defined in claim 1 wherein said plastic sheath has at least one inclined surface along said leg portion extending from said leg portion rearwardly and outwardly to said scraping section.

3. The composite tube cleaner as defined in claim 1 wherein said plurality of scraper devices are positioned on said shaft such that the leg portions of each said scraper device are offset from leg portions of an adjacent scraper device.

4. The composite tube cleaner as defined in claim 1 wherein said plurality of scraper devices comprise three of the same.

5. The composite tube cleaner as defined in claim 1 wherein said plurality of scraper devices comprise four of the same.

6. The composite tube cleaner as defined in claim 1 wherein said plastic sheath is molded on and around said scraping section and leg portion.

7. The composite tube cleaner as defined in claim 1 wherein said plastic sheath comprises nylon.

8. The composite tube cleaner as defined in claim 1 wherein an abrasive material is incorporated in the plastic used to form said plastic sheath.

9. The composite tube cleaner as defined in claim 8 wherein said abrasive material is pumice.

10. The composite tube cleaner as defined in claim 1 wherein said plastic sheath comprises a glass-filled nylon.

11. A composite tube cleaner comprising a shaft having a nose portion at a front end and a tail portion at a rear end thereof, and a plurality of spaced scraper devices secured to the shaft intermediate the nose portion and tail portion, said scraper devices comprising a metallic U-shaped scraper having a base and at least two leg portions, said leg portions extending in the direction of said tail portion and having scraping sections extending outwardly from a terminal end thereof; and a plastic sheath secured to and enclosing said scraping section and at least a portion of said leg portion, said plastic sheath having at least one inclined surface along said leg portion extending from said leg portion rearwardly and outwardly to said scraping section.

12. The composite tube cleaner as defined in claim 11 wherein two said inclined surfaces are provided on said plastic sheath, each said inclined surface adjacent a side edge of said leg portion.

13. The composite tube cleaner as defined in claim 11 wherein said plastic sheath is nylon.

14. The composite tube cleaner as defined in claim 11 wherein said plastic sheath is glass-filled nylon.

15. The composite tube cleaner as defined in claim 11 wherein an abrasive material is incorporated in the plastic used to form said plastic sheath.

16. The composite tube cleaner as defined in claim 15 wherein said abrasive material is pumice.

* * * * *